US005223940A

United States Patent [19]

Matsumoto

[11] Patent Number: 5,223,940

[45] Date of Patent: Jun. 29, 1993

[54] IMAGE RECORDING APPARATUS WITH CONTROL OF CUTTER BLADES AND RETRACTION OF RECORDING MEDIUM WEB IN RESPONSE TO DETECTION OF A CUT SHEET

[75] Inventor: Hiroaki Matsumoto, Yokohama, Japan

[73] Assignee: Canon Kabushiki Kaisha, Tokyo, Japan

[21] Appl. No.: 536,994

[22] Filed: Jun. 12, 1990

Related U.S. Application Data

[63] Continuation of Ser. No. 270,206, Nov. 14, 1988, abandoned.

[30] Foreign Application Priority Data

Nov. 13, 1987 [JP] Japan ..... 62-286729

[51] Int. Cl.[5] ..... B41J 11/70; B41J 11/52; B41J 15/04; B41J 15/16

[52] U.S. Cl. ..... 358/304; 346/24; 400/607; 400/614; 400/621.1

[58] Field of Search ..... 358/304, 296; 346/76 PH, 24; 355/310, 28, 29; 400/605, 607, 608.2, 614, 621, 621.1

[56] References Cited

U.S. PATENT DOCUMENTS

| | | | |
|---|---|---|---|
| 4,122,497 | 10/1978 | Suzuki | 358/304 |
| 4,560,990 | 12/1985 | Sue | 358/304 |
| 4,617,577 | 10/1986 | Takahashi | 346/76 PH |
| 4,660,053 | 4/1987 | Tsutsumi | 346/76 PH |
| 4,663,638 | 5/1987 | Hirose | 346/24 |
| 4,839,732 | 6/1989 | Murakami | 358/304 |

FOREIGN PATENT DOCUMENTS

| | | | |
|---|---|---|---|
| 094266 | 6/1983 | Japan | 358/304 |
| 59-190774 | 10/1984 | Japan . | |
| 225668 | 12/1984 | Japan | 358/304 |
| 046165 | 3/1985 | Japan | 358/304 |

*Primary Examiner*—Benjamin R. Fuller
*Assistant Examiner*—Scott A. Rogers
*Attorney, Agent, or Firm*—Fitzpatrick, Cella, Harper & Scinto

[57] ABSTRACT

An image recording apparatus for recording an image on a recording medium, includes an: image recording device for recording an image on a recording medium, a conveying device for conveying the recording medium, and a cutter for cutting the recording medium. A detecting device is provided for detecting an amount of movement of the cutter, a control circuit is included for causing a leading edge of the recording medium to be retracted from a cutting position by a predetermined amount in response to the detection by the detecting device after the recording medium has been cut.

23 Claims, 8 Drawing Sheets

IMAGE RECORDING APPARATUS WITH CONTROL OF CUTTER BLADES AND RETRACTION OF RECORDING MEDIUM WEB IN RESPONSE TO DETECTION OF A CUT SHEET

This application is a continuation of application Ser. No. 07/270,206 filed Nov. 14, 1988, now abandoned.

BACKGROUND OF THE INVENTION

1. Field of the Invention

The present invention relates to an image recording apparatus having a sheet cutting function for cutting a sheet.

The image recording apparatus according to the present invention is applicable to, for example, facsimile systems, copying machines, word processors, electronic typewriters, printing apparatus and the like.

2. Related Background Art

An example of a conventional image recording apparatus having a sheet cutting function will now be described in connection with a facsimile system.

In a conventional facsimile apparatus in which a recording sheet in a roll form is cut at a predetermined position, the recording sheet on which an image is printed or recorded is conveyed by a conveying roller into the cutting position, and then the recording sheet is cut by a movable cutter blade. Then, after it is detected that the movable cutter blade has been returned to a home position, the recording sheet extending from the roll is pulled back in such a manner that a leading edge of the recording sheet is returned to a printing position.

In the above-mentioned conventional recording apparatus, after the recording sheet is cut, the leading edge of the recording sheet still remains in the cutting position until the movable cutter blade returns to the home position. And, the recording sheet is retracted after the movable cutter blade has been returned to the home position. Accordingly, there occurs a waste of time for the movable cutter blade to return to the home position after completion of cutting, thus taking a long time to renew pages of the original.

Further, if a swing cutter blade is used as the movable cutter blade, since the leading edge of the cut recording sheet enters a path through which the cutter blade is returned to the home position, there is a drawback that the recording sheet may be damaged or bent, which causes jamming of the sheet when a receiving operation follows sequently. That is because the bent end of the sheet is obstructed by the cutter blade, any guide member or the like.

Such a condition will now be explained with reference to FIGS. 7A and 7B. FIGS. 7A and 7B each shows a side view of the cutting section of the conventional image recording apparatus.

In the conventional image recording apparatus shown in FIGS. 7A and 7B, the recording sheet 9a conveyed by a platen roller 10a is cut by swinging the movable cutter blade 17a. After the movable cutter blade 17a has reached its upper limited position as shown by a solid line in FIG. 7B, then rotates reversely to return to the home position as shown by a phantom line in FIG. 7B. In this case, as shown in FIG. 7A, the recording sheet 9a is cut while being lifted upward by the movable cutter blade 17a. Thereafter, when the recording sheet 9a is dropped to a side of a lower guide plate 20a by gravity, the leading edge 91a of the recording sheet will enter the path through which the movable cutter blade 17a is returned. Accordingly, as stated above, if the movable cutter blade 17a is is returned to its home position with the leading edge of the sheet entering the return path of the cutter blade, the leading edge 91a of the recording sheet is bent or damaged by the cutter blade being returned, thus causing the danger of a jam during the further operation of the apparatus.

SUMMARY OF THE INVENTION

An object of the present invention is to provide an image recording apparatus by which an image can be stably recorded.

Another object of the present invention is to provide an image recording apparatus by which an image can be recorded more speedily.

Yet another of the present invention is to provide an image recording apparatus which prevents the jamming of a recording sheet.

A further object of the present invention is to provide an image recording apparatus wherein after a recording sheet has been cut, a rotary member is rotated in a reverse direction by a predetermined amount, thus reducing the time lost while renewing pages, and wherein, even if a swingable cutter blade is used as a movable cutter blade, a jam of the recording sheet can be prevented.

DETAILED DESCRIPTION OF THE PREFERRED EMBODIMENTS

Figure 1:
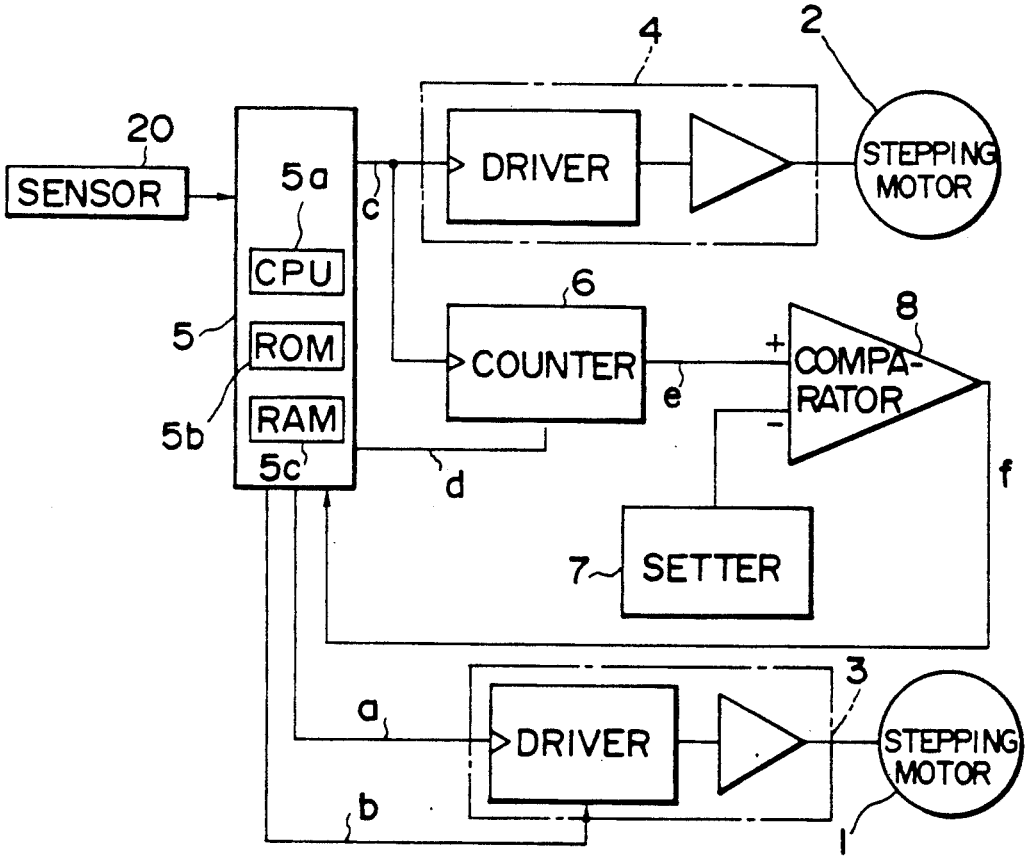
FIG. 1 is a block diagram of a facsimile system incorporating an image recording apparatus according to an embodiment of the present invention.
Figure 2:
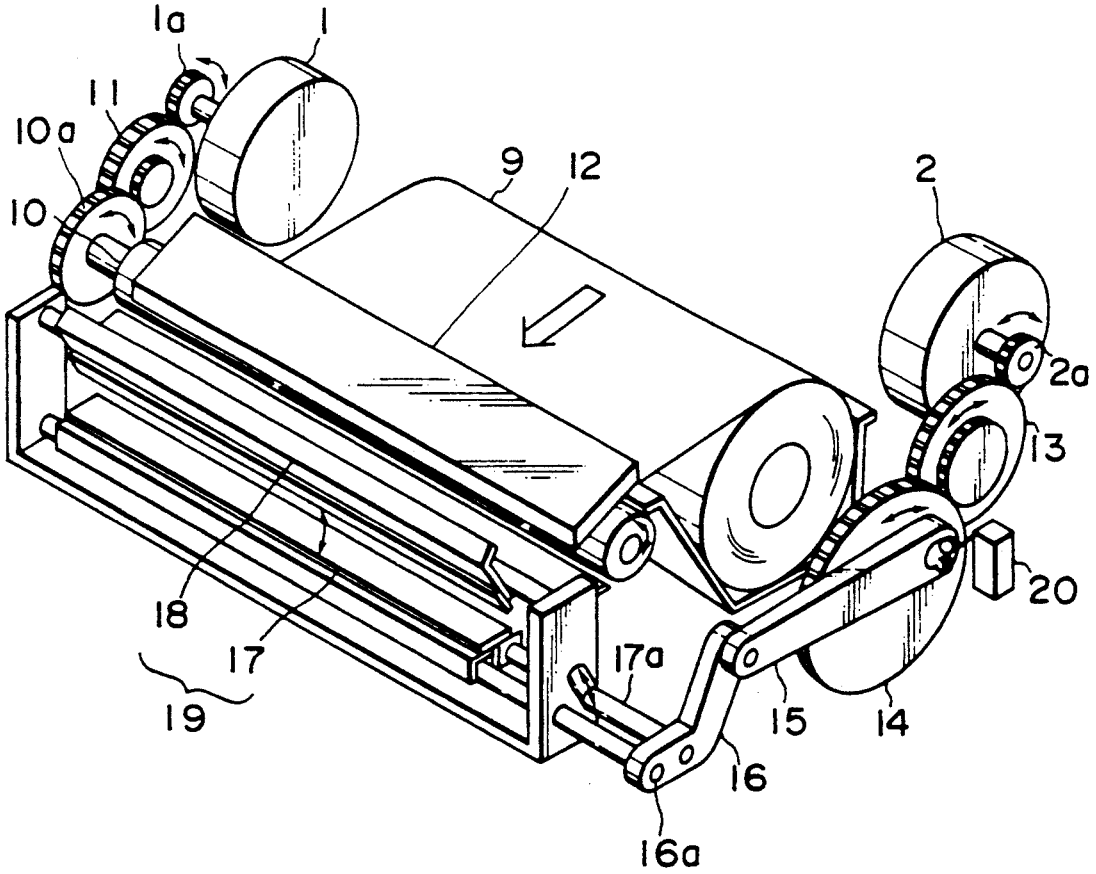
FIG. 2 is a perspective view of the facsimile system of FIG. 1.

FIG. 1 is a block diagram of a facsimile system according to a preferred embodiment of the present invention, and FIG. 2 is a perspective view of a main portion of the facsimile system of FIG. 1.

In the illustrated embodiment, as shown, the facsimile system includes a stepping motor 1 for conveying a recording sheet, a stepping motor 2 for driving a cutter, a driver 3 for the stepping motor 1, a driver 4 for the stepping motor 2, a control unit 5, a counter 6 for counting the number of pulses supplied from the control unit 5 to the driver 4, a setter 7 for previously setting a predetermined number of pulses, and a comparator 8 for comparing an output of the counter 6 with the value set in the setter 7. The control unit 5 can control the whole system and includes, for example, a CPU 5a such as a microprocessor, a ROM 5b for storing various data including a control program for the CPU 5a shown by a flow chart which will be explained later, and a RAM 5c which is used as a work area of the CPU 5a and which can temporarily store various data, and the like.

In FIG. 2 showing a perspective view of the facsimile system according to a preferred embodiment of the present invention, a platen roller 10 is a roller for conveying a roll-like thermosensitive recording sheet 9 and is driven to rotate in a forward or reverse direction by the sheet conveying stepping motor 1 through a speed reduction member 11 (such as a gear) and a gear 10a. A thermal head 12 has a plurality of heating elements (not shown) selectively heated in response to the image information and is adapted to press the platen roller 10 through the thermosensitive recording sheet 9. A reduction member 13 can reduce the power of the stepping motor 2 for driving the cutter and transmit it to a crank gear 14. A connecting rod 15 transmits the rotational force of the crank gear 14 to a rocker arm 16 as a swinging movement. The rocker arm 16 is swing around its pivot axis 16a to drive a swingable pin 17a of a movable blade 17 of a cutter 19. The movable cutter blade 17 cooperates with a fixed blade 18 of the cutter 19 to cut the recording sheet on which the image has been recorded. A sensor 20 is provided for detecting the fact that the movable cutter blade 17 is in its home position. Lastly, gears 1a and 2a are fixed to rotational shafts of the stepping motors 1 and 2 respectively.

Next, the operation of the facsimile system according to the illustrated embodiment will be explained.

Figure 3:
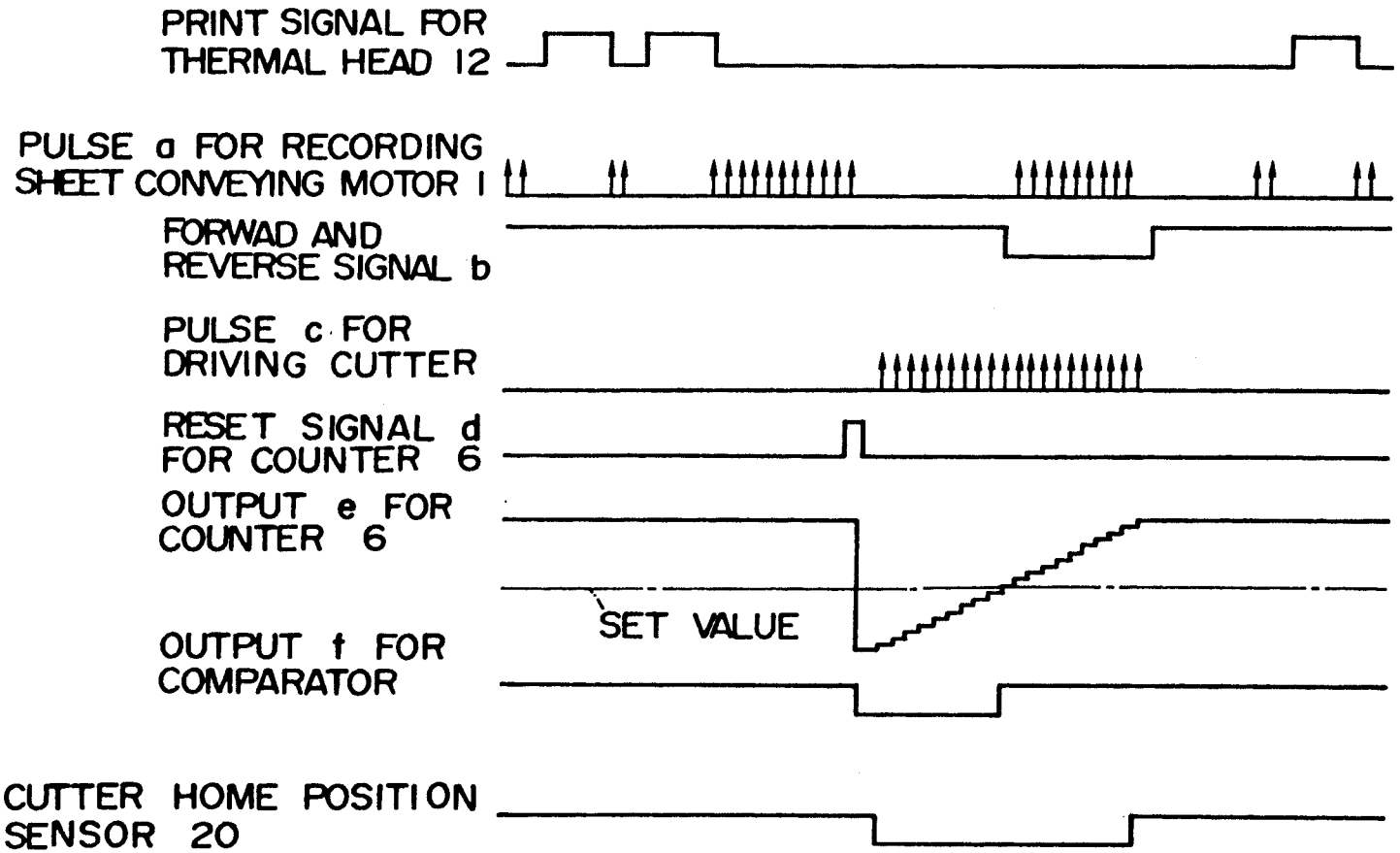
FIG. 3 is a timing chart showing signals for main parts of the block diagram of FIG. 1.
Figure 4A:
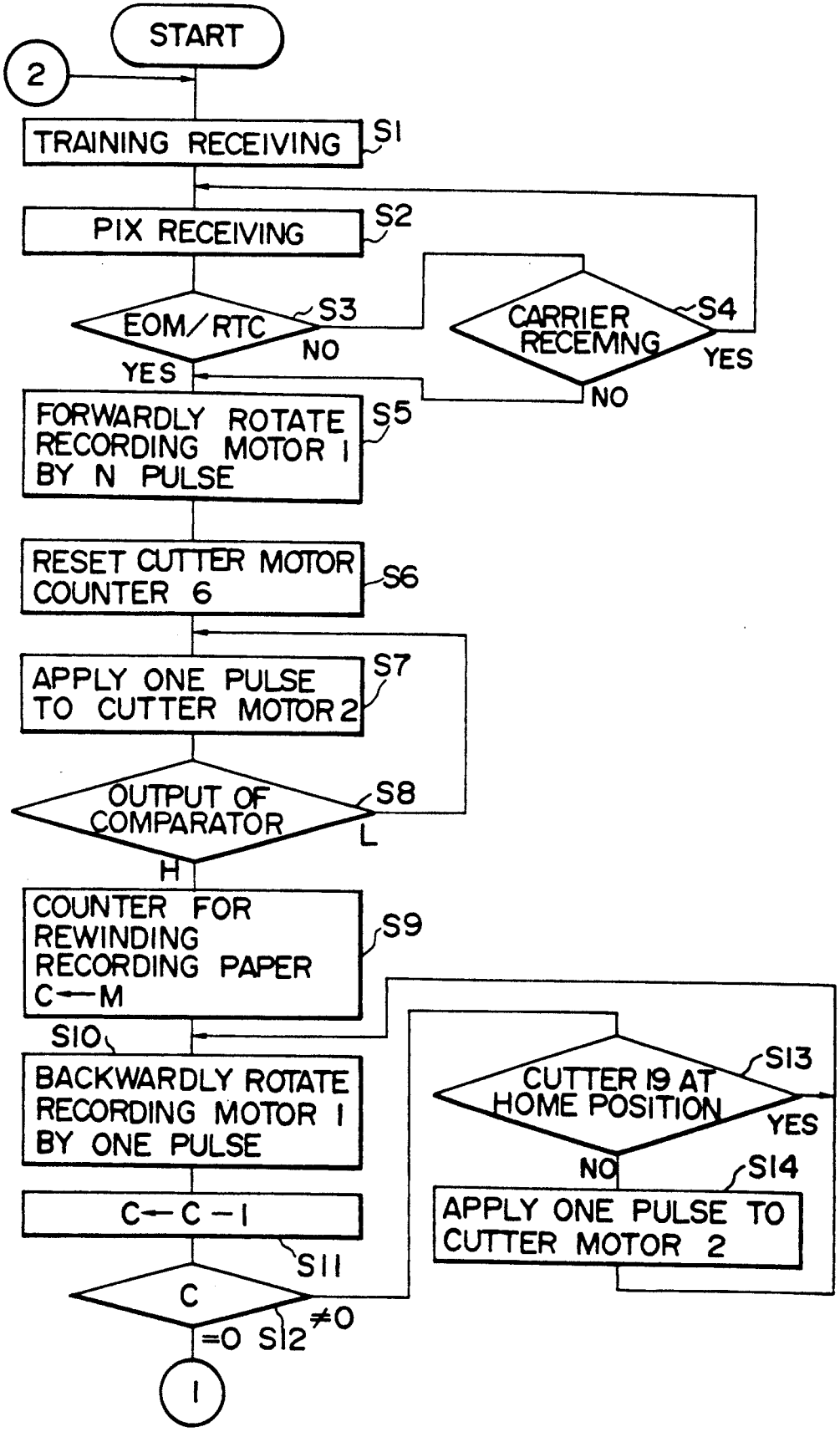
FIGS. 4A and 4B are flow charts showing the operation of the facsimile system according to the above-mentioned embodiment.
Figure 4B:
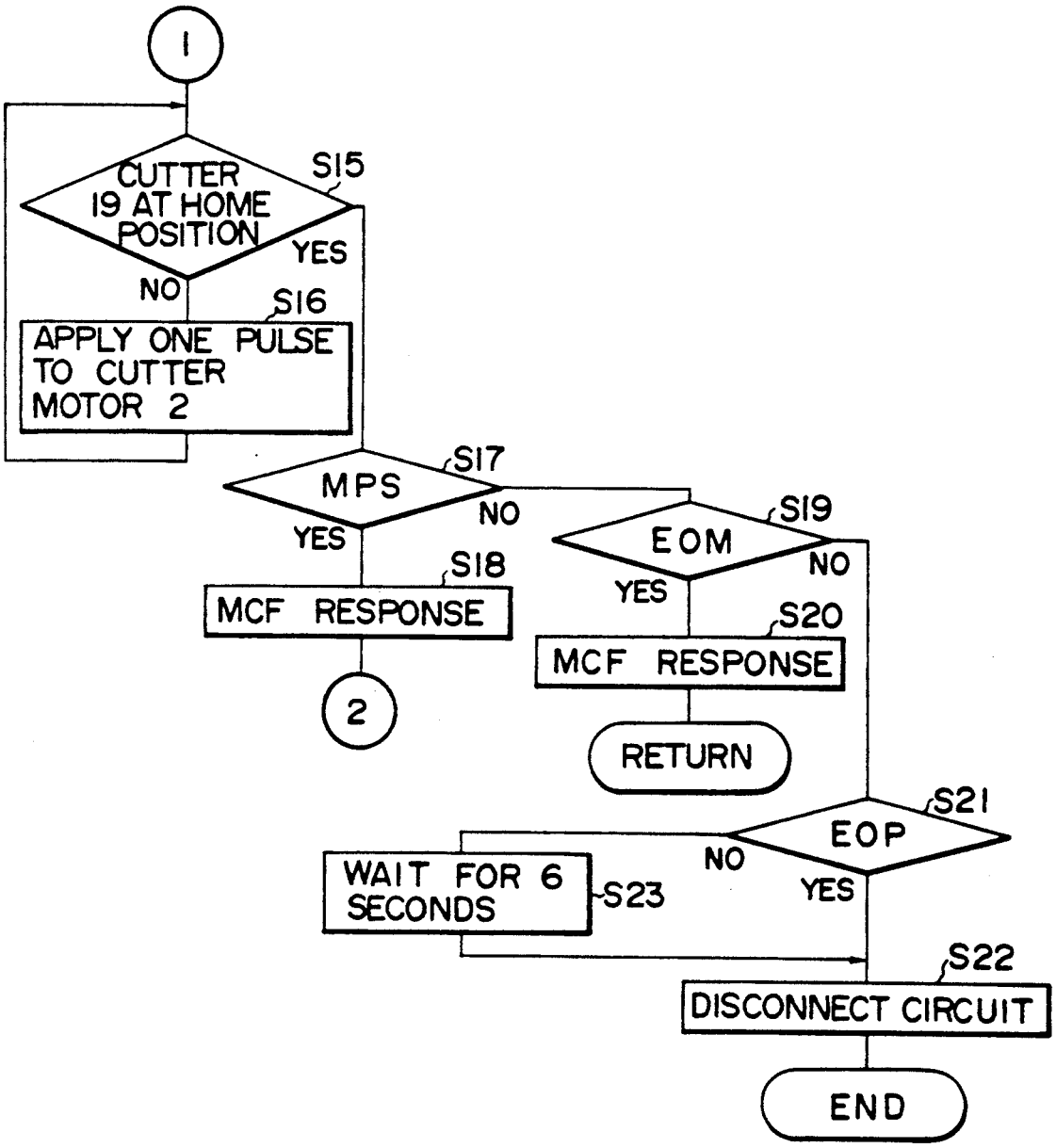

FIG. 3 is a timing chart showing various signals for the main parts in the block diagram of FIG. 1, and the facsimile system illustrated above is operated in a timed relation shown in FIG. 3. Further, FIGS. 4A and 4B show a flow chart of the operation of the above-stated embodiment.

First of all, training receiving is effected (in S1), and then PIX receiving is effected (in S2), and an image recording operation is performed. In the image recording operation, the thermal head 12 applies the heat and records the image or images onto the thermosensitive recording sheet 9 on the basis of the image data in a primary scanning direction. Thereafter, the recording sheet 9 is moved by driving the recording sheet conveying stepping motor 1 by a predetermined number of steps, thereby feeding the recording sheet in a secondary scanning direction. By repeating the image recording operations in the primary scanning direction and the sheet feeding operations in the secondary scanning direction, the images are recorded on the sheet. After the image recording for one page is completed (S3), the recording sheet conveying stepping motor 1 is energized by N pulses (in S5), thereby conveying the recording sheet 9 in a cutting position of the cutter 19. In this point, if carrier receiving is effected without EOM or a message completion signal or RTC or a control return signal (in S4), the sequence is returned to the step S2.

If a distance between a recording line of the thermal head 12 and the cutting position of the cutter 19 is L, a pitch of the recording sheet 9 moved by driving the recording sheet conveying stepping motor 1 by one pulse is P, and a tolerance area in the cutting is A, the above-mentioned numeral N (natural number) is defined by the following equation:

$$N=(L/P)+A$$

Next, the counter 6 is reset by a counter reset signal d (in S6), and a cutter driving pulse c is supplied from the control unit 5 to the driver 4 of the cutter driving stepping motor 2 (in S7), so that the movable blade 17 of the cutter 19 starts to move. In order to detect an amount of movement of the movable cutter blade 17, the counter 6 counts the number of the drive pulses c. On the other hand, the number of pulses for the cutter driving stepping motor 2 required to move the movable cutter blade 17 from the home position to the upper limited position, that is to move the movable cutter blade until the recording sheet 9 is cut, is set in the setter 7. The comparator 8 compares an output e for the counter 6 with an output or a set value from the setter 7 (in S8), and outputs the comparator output f which will be a HIGH level when the output e of the counter is larger than the set value.

Here, when the movable cutter blade 17 is rotationally moved and the recording sheet 9 has been cut by engaging the movable cutter blade 17 with the fixed cutter blade 18, the output e of the counter 6 is equal to the set value of the setter 7, and the output f of the comparator 8 is changed to the HIGH level, thereby the CPU 5a recognizes that the cutting operation has been completed. Then, a value M is set to a value C of the counter 6 for rewinding the recording sheet (in S9). In this case, the control unit 5 supplies a forward and reverse signal b to the driver 3 for the recording sheet conveying stepping motor 1, thereby driving the stepping motor 1 in the reverse direction by M pulses (in S10), thus decreasing the value C by one decrement (in S11).

If a tolerance area for preventing the leading edge of the recording sheet 9 from deviating from the recording line of the thermal head 12 is B, the above-mentioned value M will be defined by the following equation:

$$M=(L/P)-B$$

While the recording sheet 9 is being retracted or moved upstream, the movable cutter blade 17 of the cutter 19 is returned to the home position.

In this way, since the leading edge of the recording sheet 9 is retracted toward the recording line before the movable cutter blade 17 is returned to the home position (in S12, S13, S14, S15, S16), the time required for transmitting and receiving transmission sequence signals between one page and a next page can be reduced. If the movable cutter blade 17 has not yet been returned to the home position when the leading edge of the recording sheet 9 is retracted by a predetermined distance, the operation is interrupted until the movable cutter blade 17 is returned to the home position; whereas, if the leading edge of the recording sheet 9 has not yet been retracted by the predetermined distance when the movable cutter blade 17 is returned to the home position, the operation is interrupted until the leading edge of the recording sheet 9 is retracted by the predetermined distance.

When the leading edge of the recording sheet 9 is retracted by the predetermined length and the movable cutter blade 17 is returned to the home position, if MPS or a multi-page signal is received (in S17), the sequence responds to MCF or a message confirm signal (in S18) and is returned to the step S1. In the above case, if the EOM or a message completion signal is received in place of the MPS (in S19), the sequence responds to the MCF (in S20) and goes to RETURN. In the above case, if both the MPS and the EOM are not received, the circuit is disconnected (in S22) when EOP or a sequence end signal is received (in S21), whereas, when the EOP is not received, the sequence waits 6 seconds (in S23) and thereafter disconnects the circuit.

Figures 5A, 5B:
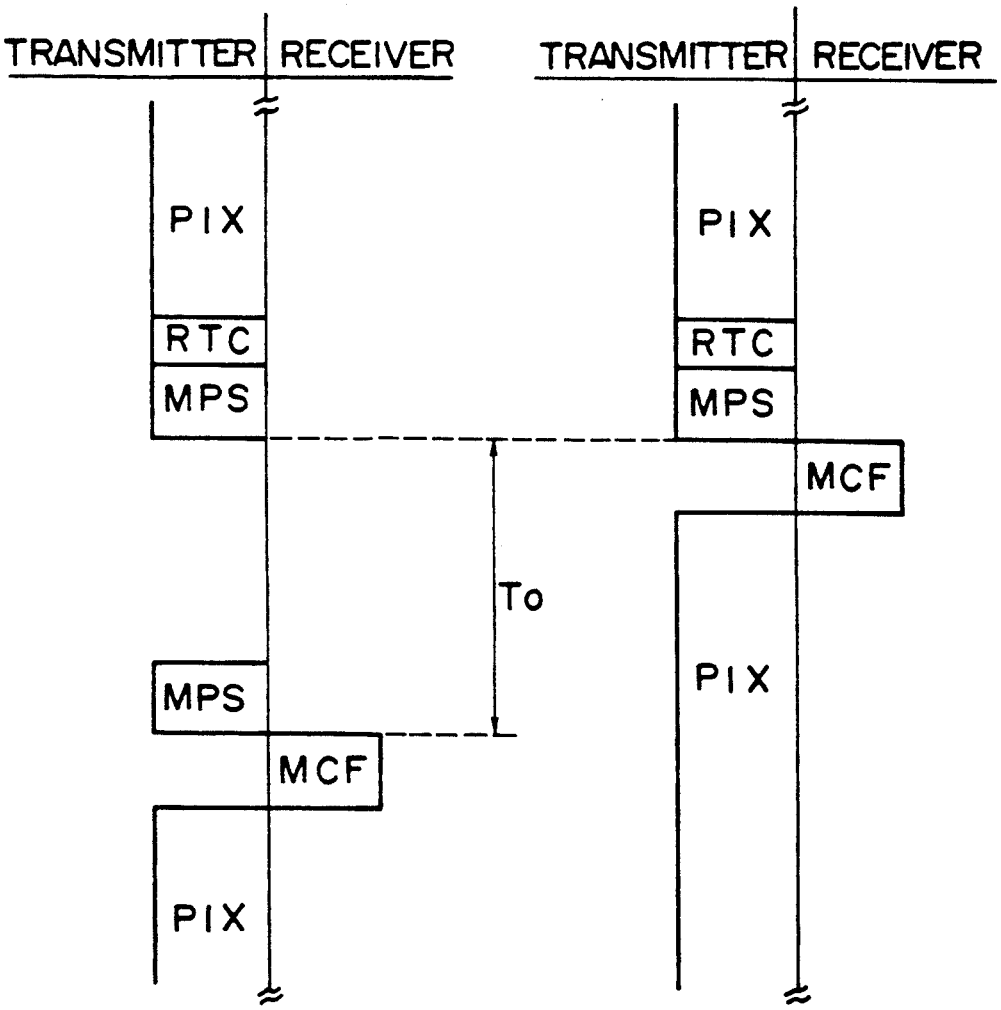
FIG.5A PRIOR ART
FIG. 5A is a view showing a transmission sequence in a conventional recording apparatus.
FIG. 5B is a view showing a transmission sequence in the facsimile system according to the above-mentioned embodiment.

That is to say, in the conventional apparatus, as shown in FIG. 5A, in a T30 sequence in a CCITT, even after a transmitter sends the PIX or an image signal, RTC or a control return signal and MPS, the retraction of the recording sheet is not completed in a receiver side. In this point, the receiver cannot send the MCF. Accordingly, while the receiver does not send the MCF, the transmitter sends the MPS again, as shown in FIG. 5A, thus creating a receivable condition. Thereafter, the receiver sends the MCF, thus receiving the image signal for the next page. However, the time T0 which is about three seconds between the first MPS and the second MPS may be a lost time.

On the other hand, in the above-mentioned facsimile system incorporating the image recording apparatus according to the illustrated embodiment of the present invention, since the operation wherein the movable cutter blade 17 is returned to the home position and the operation wherein the leading edge of the recording sheet 9 is retracted toward the recording line are performed substantially simultaneously, the time required for cutting the recording sheet is reduced. Thus, as shown in FIG. 5B, the MCS can be sent back immediately after the first MPS is received, thereby eliminating the lost time T0.

Further, in the above-mentioned embodiment, since the range of movement of the movable cutter blade 17 is monitered, and the fact that the recording sheet 9 is just cut is detected, whereby the leading edge of the remaining recording sheet 9 is retracted before the movable cutter blade 17 is returned, there is no danger that the leading portion of the remaining recording sheet 9 is bent or damaged by the cutter blades, guide plates and the like, and, thus, the recording sheet is jammed. In this case, it is sufficient that the leading edge of the recording sheet is retracted out of the path of the rocking movement of the movable cutter blade 17; so it is not necessary to retract the leading edge of the sheet up to the recording line.

Figure 6A:
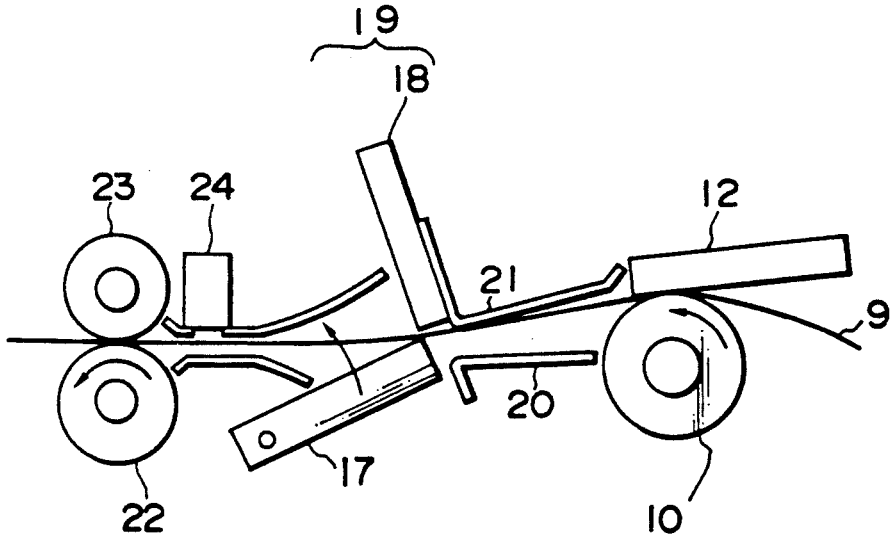
FIGS. 6A and 6B are side views of a recording apparatus according to another embodiment of the present invention.
Figure 6B:
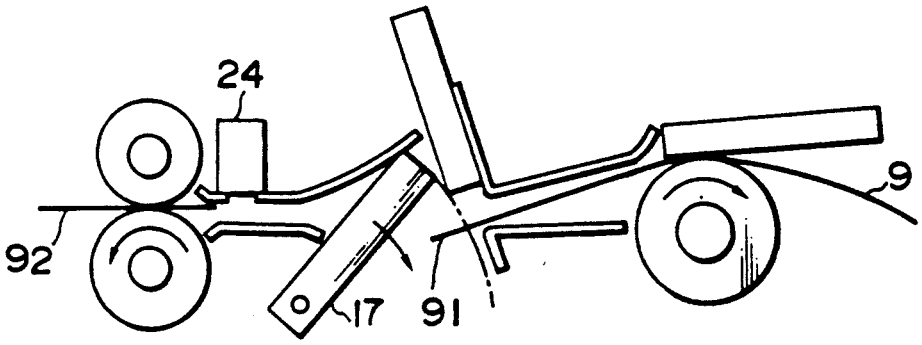

FIGS. 6A and 6B show side views of the image recording apparatus according to another embodiment of the present invention.

In the embodiment shown in these Figures, a platen roller 10, thermal head (recording head) 12, movable cutter blade 17, fixed cutter blade 18, and upper and lower guide paltes 20, 21 are constructed in the same manner as in the previous embodiment shown in FIG. 1. However, this embodiment differs from the previous embodiment in the point that it further includes a sheet discharging roller 22 and its back-up roller 23 positioned downstream of the cutter 19, and a sheet sensor 24 is arranged between the sheet discharging roller 22 and the cutter 19.

FIG. 6A shows a condition wherein the recording sheet 9 has been conveyed up to the cutting position after the image is recorded on the sheet. The movable cutter blade 17 is swing upwardly by the cutter driving stepping motor 2 (see FIG. 2), thus cutting a portion of the recording sheet on which the images are recorded, from the remaining recording sheet. In this case, an appropriate motor other than the stepping motor may be used as the cutter driving motor. The sheet discharging roller 22 may be driven through a low torque sliding clutch, or may driven by a low torque DC motor, or may be made of a material having a low coefficient of friction for facilitating the relative sliding movement between the roller surface and the recording sheet, so that the sheet discharging roller 22 is always rotated in a direction to which the recording sheet 9 is discharged.

In this way, after the recording sheet 9 is completely cut by the movement of the movable cutter blade 17, since the discharging roller 22 is not subjected to any load or resistance from the remaining recording sheet, it can eject the severed recording sheet 9 at a high speed. And, when a trailing edge of the severed recording sheet 9 has passed the sheet sensor 24, the sheet sensor 24 detects the fact that the recording sheet has been cut. Then, as shown in FIG. 6B, the platen roller 10 is rotated in the reverse direction to retract the recording sheet 9, thus shifting the leading edge of the sheet out of the path of the return movement of the movable cutter blade 17.

The sheet may be, for example, a plastic sheet, a plain sheet or the like, other than a recording sheet. Further, the present invention is not limited to the thermosensitive recording apparatus as described above, but can be applied to a so-called heat-transfer recording apparatus utilizing an inked ribbon or sheet, an electrophotographic recording apparatus, an ink jet recording apparatus and the like. Furthermore, the present invention is also not limited to the recording apparatus of the so-called full-line type as mentioned in the illustrated embodiments, but is applicable to a recording apparatus of the so-called serial type in which the image is recorded by a moving recording head.

The present invention relates to a recording apparatus having rotary member for feeding the recording sheet, and a cutter for cutting the recording sheet at a predetermined position. The rotary member may be constructed by the rotatable roller as mentioned in the above embodiments, an endless belt entrained around driving/driven pulleys or the like.

According to the illustrated embodiments of the present invention, the time required for the operation between one page and a next page can be reduced, and the jam of the recording sheet can be prevented effectively even if a swingable cutter blade is used.

As mentioned above, according to the present invention, an image recording apparatus which can record an image speedily and stably is provided.

I claim:

1. An image recording apparatus for recording an image on a recording medium, comprising:

image recording means for recording an image on a recording medium;

conveying means for conveying the recording medium along a conveyance route in a first direction and in a second direction opposite said first direction;

cutter means for cutting the recording medium by moving through a predetermined moving area while the recording medium is in said moving area;

detecting means for detecting that said cutter means has cut the recording medium; and control means for retracting the cut recording medium by a predetermined amount from a cutting position in said second direction in response to the detection by said detecting means, wherein said cutter means, after cutting the recording medium, is moved back across the conveyance route of the recording medium only after the cut recording medium is no longer in said moving area.

2. An image recording apparatus as set forth in claim 1, wherein said control means causes the recording medium to be retracted before said cutter means reaches a home position.

3. An image recording apparatus according to claim 1, wherein said cutter means is of a swingable type having a movable cutter blade and a fixed cutter blade, said movable cutter blade rotating at a predetermined angle around a support axis to cut said recording medium.

4. An image recording apparatus according to claim 1, wherein said control means begins to retract said recording medium before said cutter means returns to a home position.

5. An image recording apparatus comprising:

a rotary member for conveying a recording sheet in a first direction and a second direction opposite to said first direction;

a cutter for cutting the recording sheet by moving through a predetermined moving area while the recording sheet is in said moving area;

means for detecting that said cutter has cut the recording sheet; and conveying control means for reversing said rotary member to retract the cut recording sheet from a cutting position in said second direction along a conveyance route after said cutter has cut the recording sheet, wherein said cutter means, after cutting the recording medium, is moved back across the conveyance route of the recording medium only after the cut recording medium is no longer in said moving area.

6. An image recording apparatus as set forth in claim 5, further including a discharging roller positioned downstream of said cutter, and wherein said detecting means comprises a sheet detecting sensor arranged between said cutter and said discharging roller.

7. An image recording apparatus as set forth in claim 5, wherein said conveying control means retracts said recording sheet by a distance corresponding to a distance between said cutting position of said cutter and an image recording position.

8. An image recording apparatus according to claim 5, wherein said cutter is of a swingable type having a movable cutter blade and a fixed cutter blade, said movable cutter blade rotating at a predetermined angle around a support axis to cut said recording sheet.

9. An image recording apparatus according to claim 5, wherein said control means begins to retract the recording sheet before said cutter returns to a home position.

10. An image recording apparatus comprising:

a rotary member for conveying a recording sheet in a first direction and in a second direction opposite said first direction;

a cutter for cutting said recording sheet;

means for detecting that said cutter has cut said recording sheet;

conveying control means for reversing said rotary member to retract the cut recording sheet from a cutting position and in said second direction after said cutter has cut the recording sheet;

a stepping motor for driving said cutter; and a counter for counting a number of drive pulses supplied to said stepping motor, and wherein said detecting means has a comparator for comparing an output value of said counter with a number of pulses corresponding to a position where the cutting is competed by said cutter.

11. An image recording apparatus according to claim 10, wherein said detecting means detects that said cutter means has cut said recording medium by detecting an amount of movement of said cutter means.

12. An image recording apparatus as set forth in claim 10, wherein said conveying control means retracts said recording sheet by a distance corresponding to a distance between said cutting position of said cutter and an image recording position.

13. An image recording apparatus for recording an image on a recording medium, comprising:

image recording means for recording an image on a recording medium;

conveying means for conveying the recording medium along a conveyance route in a first direction and in a second direction opposite said first direction;

a recording medium motor for driving said conveying means;

cutter means having a movable cutter blade and a fixed cutter blade for cutting the recording medium by engaging said movable cutter blade and said fixed cutter blade;

a cutter motor for driving said cutter means;

detecting means for detecting that said cutter means has cut the recording medium; and control means for reversing the recording medium motor after said recording medium has been cut in response to the detection by said detecting means to retract the cut recording medium by a predetermined distance from a cutting position in said second direction, wherein said cutter means, after cutting the recording medium, is moved back across the conveyance route of the recording medium only after the cut recording medium is no longer in said moving area.

14. An image recording apparatus as set forth in claim 13, wherein said recording medium motor and said cutter motor comprise a stepping motor, respectively 15. An image recording apparatus as set forth in claim 13, wherein said control means causes the recording medium to be retracted before said cutter means reaches a home position.

16. An image recording apparatus according to claim 13, wherein said control means begins to retract said recording medium before said cutter means returns to a home position.

17. An image recording apparatus as set forth in claim 13, wherein said control means retracts said recording sheet by a distance corresponding to a distance between said cutting position of said cutter means and an image recording position.

18. An image recording apparatus for recording an image on a recording medium, comprising:

image recording means for recording an image on a recording medium;

conveying means for conveying said recording medium in a first direction and in a second direction opposite said first direction;

cutter means for cutting said recording medium;

detecting means for detecting that said cutter means has cut said recording medium; and control means for retracting the cut recording medium by a predetermined amount from a cutting position in said second direction in response to the detection by said detecting means, wherein said detecting means detects that said cutter means has cut said recording medium by detecting an amount of movement of said cutter means.

19. An image recording apparatus comprising:

a rotary member for conveying a recording sheet in a first direction and a second direction opposite to said first direction;

a cutter for cutting said recording sheet;

means for detecting that said cutter has cut said recording sheet; and conveying control means for reversing said rotary member to retract the cut recording sheet from a cutting position in said second direction after said cutter has cut said recording sheet, wherein said detecting means detects that said cutter has cut said recording sheet by detecting an amount of movement of said cutter.

20. An image recording apparatus for recording an image on a recording medium, comprising:

image recording means for recording an image on a recording medium;

conveying means for conveying said recording medium in a first direction and in a second direction opposite said first direction;

a recording medium motor for driving said conveying means;

cutter means having a movable cutter blade and a fixed cutter blade for cutting said recording medium by engaging said movable cutter blade and said fixed cutter blade;

a cutter motor for driving said cutter means;

detecting means for detecting that said cutter means has cut said recording medium; and control means for reversing said recording medium motor after said recording medium has been cut in response to the detection by said detecting means to retract the cut recording medium by a predetermined distance from a cutting position in said second direction, wherein said detecting means detects that said cutter means has cut said recording medium by detecting an amount of movement of said cutter means.

21. An image recording apparatus according to claims 1, 5, 10, 13, 18, 19 or 20, wherein said image recording apparatus is a facsimile apparatus.

22. An image recording apparatus according to claim 1, 5, 10, 13, 18, 19 or 20, wherein said image recording apparatus is a thermal recording apparatus.

23. An image recording apparatus according to claim 1, 5, 10, 13, 18, 19 or 20, wherein said image recording apparatus is an ink jet recording apparatus.

* * * * *

UNITED STATES PATENT AND TRADEMARK OFFICE

CERTIFICATE OF CORRECTION

PATENT NO. : 5,223,940

DATED : June 29, 1993

INVENTOR(S) : HIROAKI MATSUMOTO

It is certified that error appears in the above-identified patent and that said Letters Patent is hereby corrected as shown below:

On title page,

IN [22] FILING DATE

"Jun. 12, 1990" should read --Jun. 13, 1990--.

IN [57] ABSTRACT

Line 3, "an:" should read --an--.
Line 8, "cutter," should read --cutter, and--.

On drawing sheet

SHEET 3 OF 8

FIG. 3, "FORWAD" should read --FORWARD--.

COLUMN 1

Figure 7A:
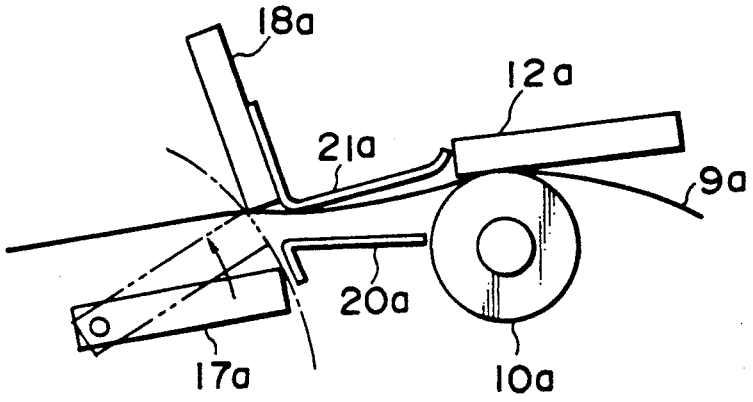
FIG. 7A PRIOR ART
FIGS. 7A and 7B are side views of a conventional recording apparatus.
Figure 7B:
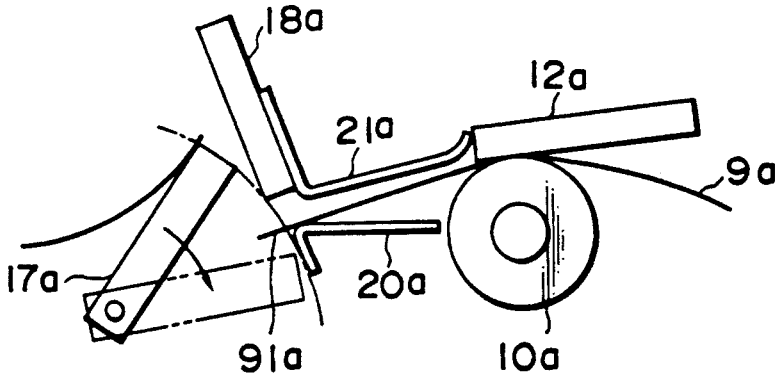

Line 61, "FIG. 7B, then" should read --FIG. 7B, it then--.

COLUMN 3

Line 19, "swing" should read --swung--.

COLUMN 5

Line 32, "monitered," should read --monitored,--.
Line 61, "swing" should read --swung--.

COLUMN 6

Line 33, "having" should read --having a--.

--

UNITED STATES PATENT AND TRADEMARK OFFICE

CERTIFICATE OF CORRECTION

PATENT NO. : 5,223,940

DATED : June 29, 1993

INVENTOR(S) : HIROAKI MATSUMOTO

It is certified that error appears in the above-identified patent and that said Letters Patent is hereby corrected as shown below:

COLUMN 10

Line 20, "claim" should read --claims--.
Line 23, "claim" should read --claims--.

Signed and Sealed this

Twelfth Day of April, 1994

Bruce Lehman

*Attest:*

BRUCE LEHMAN

*Commissioner of Patents and Trademarks*

*Attesting Officer*